United States Patent [19]

Beasley

[11] Patent Number: 4,592,414

[45] Date of Patent: Jun. 3, 1986

[54] HEAT EXCHANGER CORE CONSTRUCTION UTILIZING A PLATE MEMBER ADAPTABLE FOR PRODUCING EITHER A SINGLE OR DOUBLE PASS FLOW ARRANGEMENT

[75] Inventor: Marvin D. Beasley, Mount Vernon, Ill.

[73] Assignee: McCord Heat Transfer Corporation, Walled Lake, Mich.

[21] Appl. No.: 708,827

[22] Filed: Mar. 6, 1985

[51] Int. Cl.[4] ..... F28F 3/10

[52] U.S. Cl. ..... 165/76; 29/157.3 D; 165/153; 165/167; 165/170

[58] Field of Search ..... 165/166, 167, 153, 137, 165/170, 174, 177, 76; 29/157.3 D, 463

[56] References Cited

U.S. PATENT DOCUMENTS

| | | | |
|---|---|---|---|
| 1,029,099 | 6/1912 | Behringer | 29/157.3 D |
| 1,158,576 | 11/1915 | Sonneborn | 29/157.3 D |
| 2,538,043 | 4/1951 | Roy et al. | 29/463 |
| 2,814,159 | 11/1957 | Green | 29/463 |
| 4,298,061 | 11/1981 | Hoeffken | 29/157.3 D |
| 4,301,864 | 11/1981 | Kivikas et al. | 165/174 X |
| 4,308,915 | 1/1982 | Sanders et al. | 165/166 |
| 4,350,201 | 9/1982 | Steinman | 165/76 |
| 4,407,359 | 10/1983 | Berger et al. | 165/167 |
| 4,470,455 | 9/1984 | Sacca | 165/167 |

FOREIGN PATENT DOCUMENTS

| | | | |
|---|---|---|---|
| 739350 | 10/1955 | United Kingdom | 29/463 |

*Primary Examiner*—Sheldon J. Richter
*Assistant Examiner*—Randolph A. Smith
*Attorney, Agent, or Firm*—Haverstock, Garrett and Roberts

[57] ABSTRACT

A heat exchanger construction of the plate and fin type comprising a plurality of plate assemblies joined together in a stackable arrangement, each plate assembly being formed by a pair of similar plate members placed in mating face-to-face relationship with each other to form a central flow region therebetween. Each plate member includes a header portion located respectively adjacent each opposite end thereof, each header portion having at least one pair of spaced openings adaptable for receiving and discharging a fluid medium therethrough. A raised partitioning or pass rib is positioned extending between the pair of spaced openings associated with one of the header portions and depending upon the positioning of the respective pass ribs relative to one another when each respective pair of plate members are joined together either a single-pass or a double-pass flow system is formed therebetween. Each plate member additionally includes spaced flange tabs arranged along the periphery thereof, the flange tabs being positioned and arranged so as to register with and engage untabbed edge portions of a similar plate member when placed in mating relationship therewith thereby forming a continuous sidewall therearound between the mated plate members regardless of whether the plate members are joined together to produce a single-pass or a double-pass flow arrangement.

21 Claims, 7 Drawing Figures

Double-Pass Flow Arrangement

Single-Pass Flow Arrangement

HEAT EXCHANGER CORE CONSTRUCTION UTILIZING A PLATE MEMBER ADAPTABLE FOR PRODUCING EITHER A SINGLE OR DOUBLE PASS FLOW ARRANGEMENT

BACKGROUND OF THE INVENTION

The present invention relates to a heat exchanger core construction adaptable for use in charged air cooler assemblies for turbo-charged internal combustion engines and, more particularly, to a heat exchanger core construction of the plate and fin type wherein a plurality of identical elongated plate members are joined together in a stackable mating arrangement such that either a single-pass or a double-pass system is formed between each respective pair of plate members so joined depending upon the particular orientation thereof. When two of the present core plate members are joined together in face-to-face relationship, a heat exchanger element is formed having a central flow region therebetween. In one orientation, the mated core plate members form a double-pass flow arrangement therebetween whereas a single-pass flow arrangement may be achieved by simple reorientation of the mating core plate members. The provision for achieving single or double pass fluid flow arrangements by utilizing a universal core plate member significally reduces the tooling requirements for producing a family of heat exchanger constructions as needed for a wide variety of applications.

DESCRIPTION OF THE PRIOR ART

A wide variety of heat exchanger core constructions have been designed and manufactured for use as heat exchangers in a wide variety of applications such as for use in turbo-charged internal combustion engines and other applications. The use of heat exchangers in an extremely wide range of industrial and commercial applications coupled with the highly desirable goals of energy conservation and fuel economy in all heat and energy related devices have resulted in a rapidly growing worldwide demand for the design of efficient, reliable, and economical heat exchanger equipment.

Typical of such heat exchanger core constructions is the plate and fin type construction wherein heat transfer is effected between one fluid medium flowing through the central flow region formed by a pair of mated plate members and a second fluid medium flowing externally over the central flow region through flow passageways formed by and between fin elements that are interposed between adjacent plate assemblies to increase the effective heat transfer therebetween. In such a construction, a transfer of heat occurs directly between the fluid medium flowing within the central flow region and the external fluid medium flowing over and around the plate members.

The construction of a typical plate member generally includes a header portion at each opposite end thereof. A pair of plate members are mated together to form a plate assembly and when stacked one upon the other, the header portions associated with each plate assembly mate with the header portions of adjacent plate assemblies and form inlet or outlet headers adaptable to receive and discharge a fluid medium therethrough. Typically, however, the construction of each plate member limits the use thereof to a specific type of fluid flow through the core construction. For example, Donaldson U.S. Pat. No. 3,207,216 discloses a core plate construction wherein the plate members are constructed such that when the plate members are mated together, a single-pass flow arrangement is produced. Slaasted et al U.S. Pat. No. 3,017,161 discloses a core plate construction wherein each plate member includes intermediate portions such that, when mated together, they produce a double-pass flow arrangement. DeGroote et al U.S. Pat. No. 3,907,032 discloses a heat exchanger construction wherein a plurality of tubes and header portions produce a multi-pass flow arrangement. Each of these constructions, however, is limited to the specific flow arrangement described therein and to change any one of the specific types of flow arrangements disclosed respectively therein would require complete restructuring of the core plate members to achieve the newly desired pass flow arrangement. Thus, a user of a variety of fluid flow arrangements must have a variety of plate member constructions available and the manufacturers of such plate members must produce and provide this variety of plate members to meet the specific needs of the user. Manufacture and use of the prior art core plate devices are therefore not only expensive but likewise inconvenient.

SUMMARY OF THE INVENTION

The present heat exchanger core construction overcomes many of the disadvantages and shortcomings associated with prior art plate type heat exchanger constructions, and teaches the construction and operation of a heat exchanger construction that utilizes a plurality of identical plate members which may be stackably arranged in various mating positions to produce either a single-pass or a double-pass cross-flow system. The construction of the universal core plate member utilized in the present invention substantially reduces the costly tooling requirements necessary to manufacture a wide variety of plate member constructions and provides the user with the ability to use the same core plate member in both single-pass and double-pass flow applications. Since users of both single-pass and double-pass core assemblies will no longer need to purchase and stock multiple core plate constructions to achieve the desired pass flow system, use of the present core plate members will reduce user cost and inventory.

The present heat exchanger core construction comprises individual core plate members having a dished or header portion formed integrally therewith at each opposite end thereof. Each header portion preferably includes at least a pair of openings adaptable for registration with corresponding openings on an adjacent plate member to fluidly interconnect the adjacent header portions such that one fluid medium may pass therethrough and circulate through the central flow region formed between mating plate members as will be hereinafter explained. The openings located in the dished or header portions of each plate member are preferably symmetrically arranged at each end thereof and the openings associated with the header portion located at one end of the plate member have corresponding complementary openings associated with the header portion located at the opposite end thereof. In addition, circumferential flange members surround at least one of the openings in each header portion to aid in positioning and stacking the respective pairs of mated plate members. Each core plate member also includes a raised partitioning or pass rib preferably formed integral therewith and positioned between the pair of openings associated with only one of the header portions. This raised pass rib is important to the present invention because it is the positioning of the respective pass ribs associated with each pair of mated plate members relative to one another which determines the particular flow arrangement of the core assembly embodying the present plate members. Each core plate member additionally includes spaced flange tabs arranged asymmetrically along the periphery thereof to facilitate the positioning of one core plate member relative to another when assembling the same. These flange tabs are positioned so as to be adaptable to register with and engage an untabbed edge portion of a complementary plate member when placed in mating relationship therewith to form either of the flow arrangements hereinafter described.

When two of the present core plate members are assembled in face-to-face relationship with each other and the raised pass ribs associated with one of the header portions on each of the respective plate members are positioned and arranged in abutting relationship with each other, one header portion of the formed heat exchanger element is separated into two distinct sections thereby providing separate means for coolant fluid to enter and exit the central flow region formed therebetween. By arranging one corrugation of an interposed elongated single strip fin member or other partitioning member in alignment with the abutting pass ribs at one end portion of the plate assembly and extending the elongated partitioning member the full length of the mated core plate members, each pair of core plate members so joined is effectively separated into two coolant passes thereby achieving a double-pass flow arrangement within each heat exchanger element or plate assembly. A single-pass flow arrangement may likewise be produced by joining together two core plate members in face-to-face relationship with each other such that the raised pass ribs associated with the one header portion of the respective plate members are located at opposite ends thereof. This arrangement allows a coolant fluid to enter one header portion and flow freely within the single flow region formed between the mated core plate members and thereafter exit through the header portion located at the opposite end thereof. Use of the present core plate members provides an improved means for providing separation of adjacent flow passageways within the central flow region formed between the respective pairs of mated plate members and this makes the present plate members particularly suitable for, but not limited to, use in charged air cooler assemblies for turbo charged engines.

A typical core assembly embodying the present core plate members is produced by stacking the mated plate assemblies one upon the other and interposing heat transfer fin elements between adjacent plate assemblies, the fin elements extending throughout the full interior area therebetween forming a second series of relatively small fluid flow passageways therewithin for receiving and transporting a second fluid medium, such as air, therethrough. The second series of fluid passageways extend in a direction perpendicular to the central flow region formed between each pair of mated plate members thereby achieving a cross-flow pattern of fluid distribution through the heat exchanger core structure.

It is therefore a principal object of the present invention to provide an improved heat exchanger core construction utilizing a plurality of identical core plate members that may be stackably arranged in various mating positions to produce either a single-pass or a double-pass fluid cross-flow system.

Another object is to provide a single core plate member which may be utilized to form either a single-pass or a double-pass flow arrangement through the central flow region formed between mating core plate members.

Another object is to teach the construction of a core plate member which will substantially reduce the tooling requirements for producing a family of heat exchanger core assemblies.

Another object is to provide an improved heat exchanger core contruction utilizing core plate members that are easily stacked and positioned without the use of jigs or other supporting apparatus.

Another object is to provide an improved heat exchanger core construction having improved strength and stability.

Another object is to provide an improved heat exchanger core construction including means associated with the respective core plate members for providing a solid bond therebetween when said plate members are stackably arranged one upon the other.

Another object is to provide an improved means for providing separation of adjacent flow passageways within the central flow region formed between respective pairs of core plate members.

Another object is to provide an improved heat exchanger core construction that is structurally and operationally relatively simple and inexpensive.

Another object is to provide a core construction which can be economically produced for commercial use.

These and other objects and advantages of the present invention will become apparent to those skilled in the art after considering the following detailed specification which discloses several embodiments of the subject device in conjunction with the accompanying drawings.

DETAILED DESCRIPTION OF A PREFERRED EMBODIMENT

Figure 1:
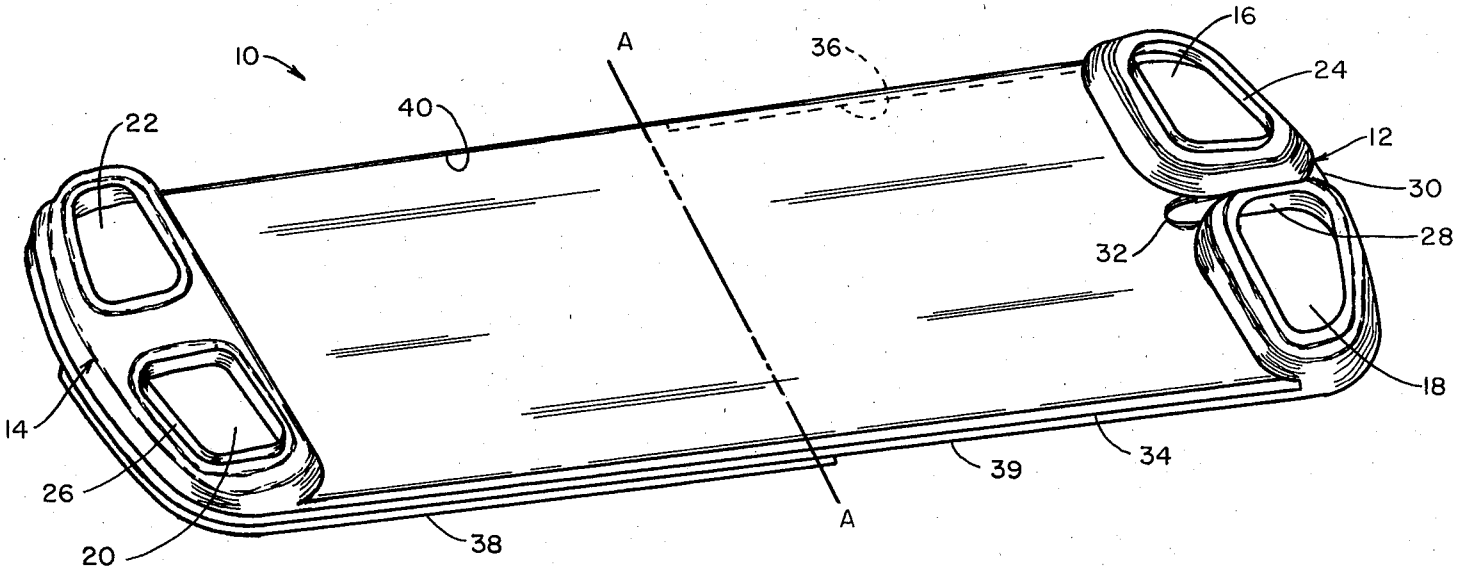
FIG. 1 is a perspective view of a core plate member constructed according to the teachings of the present invention.
Figure 2:
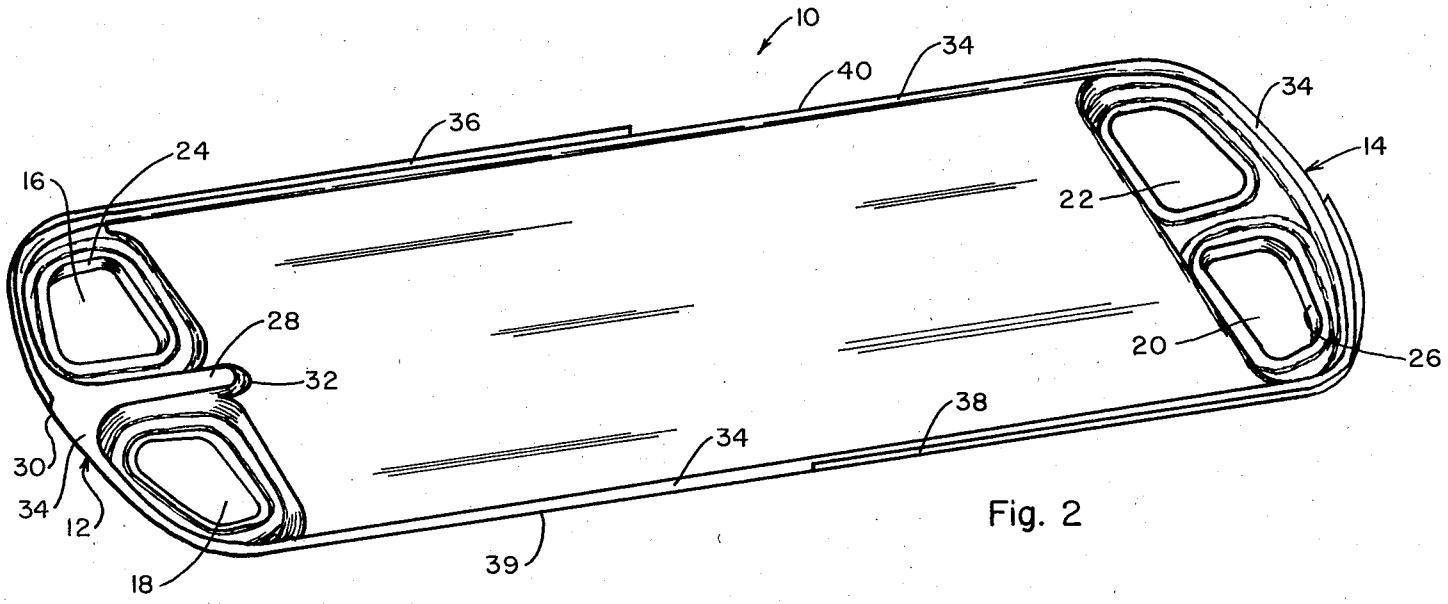
FIG. 2 is a perspective view of the plate member of FIG. 1 rotated 180° about the transverse axis A—A.

Referring to the drawings more particularly by reference numbers wherein like numerals refer to like parts, number 10 in FIGS. 1 and 2 refers to a core plate member constructed according to the teachings of the present invention. Each plate member 10 is substantially flat in shape and each includes dished or header portions 12 and 14 located respectively at each opposite end thereof. The header portions 12 and 14 are preferably integrally formed with each plate member 10 although any suitable means for attaching the header portions to the plate number 10 may be utilized. Each header portion 12 includes a pair of spaced openings 16 and 18 and each header portion 14 includes a pair of spaced openings 20 and 22 as shown in FIGS. 1 and 2. The header openings 16, 18, 20 and 22 are adaptable for registration with corresponding openings on an adjacent plate member 10 to fluidly interconnect adjacent header portions such that one fluid medium may pass therethrough and circulate through the central flow region formed between mating plate members as will be explained. The openings located in the dished or header portions 12 and 14 of each plate member 10 are symmetrically arranged at each end thereof and the openings associated with the header portion 12 have corresponding complementary openings associated with the header portion 14. When stacked one upon the other, the respective header portions form the header tanks of the present core constructions. Circumferential flange members 24 and 26 are likewise utilized to further secure the connection between respective header portions as will be hereinafter explained.

Each core plate member 10 also includes a raised pass or partitioning rib 28 perferably intergrally formed with only one of the header portions associated with each plate member such as the header portion 12 shown in FIGS. 1 and 2. The pass rib 28 is positioned between the pair of openings 16 and 18 and extends from one end 30 of the header portion 12 to the other end 32 thereof. A continuous raised peripheral edge portion 34 (FIG. 2) extends around each of the plate members 10 on one surface thereof and the partitioning or pass rib 28 associated with each header portion 12 extends from and lies coplanar with the peripheral edge portion 34. Each core plate member additionally includes spaced flange tabs 36 and 38 arranged and positioned asymmetrically along the peripheral edge 34 to facilitate the positioning of one plate member 10 relative to another when assembling the same. The flange tabs 36 and 38 are positioned and located as shown in FIGS. 1 and 2 so as to be adaptable to register with and engage complementary untabbed edge portions such as the untabbed portions 39 and 40 of a complementary plate member 10 when placed in face-to-face mating relationship therewith. It is important to note that the complementary untabbed edge portions associated with the present plate member 10 are substantially equal in length to tne corresponding flange tabs and the untabbed portions are positioned substantially directly opposite the position of the flange tabs as shown in FIGS. 1 and 2. When two of the present plate members 10 are joined in mating face-to-face relationship with one another, the flange tabs 36 and 38 of one plate member engage respective untabbed portions 39 and 40 of the other plate member thereby forming a continuous sidewall 41 between pairs of mated plate members 10 as best shown in FIG. 3.

In the perferred embodiment shown in FIGS. 1 and 2, the flange tabs 36 and 38 are arranged along the periphery of plate member 10 such that the flange tab 36 extends from a position adjacent the partitioning rib 28 to an intermediate position along the peripheral side edge 34 such that the length thereof is equal to approximately one quarter of the distance around the entire periphery thereof. The flange tab 38 is spaced from the flange tab 36 a distance equal to the length of the flange tab 36 and extends similarly from a position adjacent the space between the pair of openings 20 and 22 associated with the header portion 14 to an intermediate position along the opposite peripheral side edge 34 such that the length thereof is likewise equal to approximately one quarter of the distance around the entire periphery of plate member 10. This specific arrangement of the flange tabs 36 and 38 not only facilitates the positioning of the core plate members 10 during assembly but also assists in securing a solid bond between the respective plate members during the brazing operation. In this situation, the bonding material, for example, a brazing alloy, can flow readily into the juncture between the peripheral flange tabs 36 and 38 of one plate member 10 and the untabbed edged portions 39 and 40 associated with the mating plate member 10 to firmly seal the same and provide an effective joinder therebetween. It is also recognized and anticipated that other arrangements of the flange tabs around the periphery of the plate members 10 may likewise be utilized wherein each flange tab on one plate member 10 is registrable and engageable with a corresponding untabbed portion on a complementary plate member 10 when said plate members are placed in face-to-face mating relationship with one another. However, the specific arrangement of tabbed and untabbed portions hereinbefore described and shown in FIGS. 1 and 2 is preferred because plate members utilizing such an arrangement have a minimum of continuous tabbed and untabbed portions associated therewith and are therefore simpler and less expensive to manufacture as compared to plate members having a different arrangement and a greater plurality of such tabbed and untabbed portions.

Figure 3:
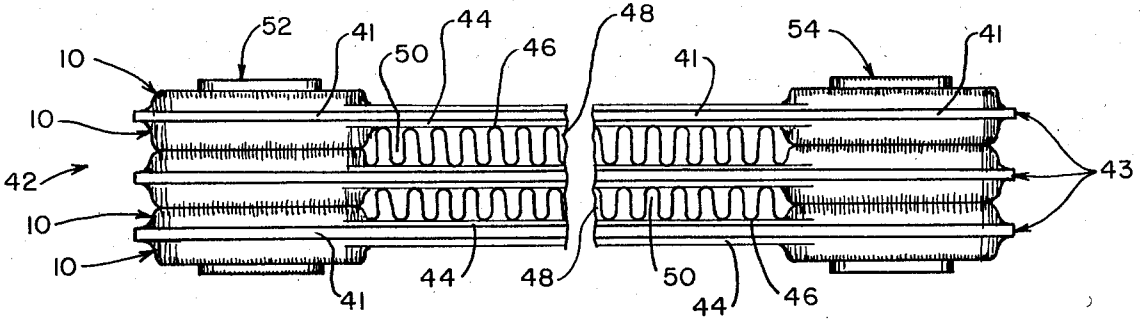
FIG. 3 is a side elevational view of a plurality of plate assemblies stacked one upon the other with heat transfer fin elements interposed between adjacent plate assemblies, each plate assembly being formed by mating together two of the plate members of FIG. 1.

As shown in FIG. 3, a heat exchanger core assembly 42 is formed by joining together a plurality of plate members 10. More specifically, when two of the present plate members 10 are joined together in face-to-face relationship with the flange tabs 36 and 38 of one plate member engaging the untabbed portions 39 and 40 of a complementary plate member as previously explained, a heat exchanger element or plate assembly 43 is formed having a central flow region 44 extending substantially the entire width between the joined plate members. To provide a further secured connection between adjacent pairs of mated plate members 10, one opening in each of the header portions 12 and 14 such as the openings 16 and 20 is provided with a circumferential flange member surrounding the same such as the flange members 24 and 26 respectivey as shown in FIGS. 1 and 2. The flange members 24 and 26 are receivable and insertable within the complementary unflanged header openings 18 and 22 in an adjacent pair of mated plate members or plate assemblies 43 to further aid in positioning and stacking the plate assemblies 43 without the use of jigs or other supporting hardware. This likewise improves the strength and stability of the entire core unit 42 and also helps to provide a solid bond between the respective pairs of plate members or assemblies 43 during the brazing operation. The circumferential flange members 24 and 26 also serve to fluidly interconnect the respective header openings between adjacent plate assemblies.

A typical heat exchanger core assembly 42 embodying the present invention comprises a plurality of the plate assemblies 43 stacked one upon the other with serpentine heat transfer fins 46 interposed between adjacent plate assemblies. The serpentine fin elements 46 extend throughout the full interior area 48 formed between the stacked plate assemblies 43 and form a second series of relatively small fluid flow passageways 50 therewithin for receiving and transporting a second fluid medium, such as air, therethrough. It should be noted that various types of serpentine fin elements may be utilized, for example, they may be smooth, perforated, lanced, or they may be louvered. When stacked one upon the other, the header portions 12 and 14 associated with each pair of mated plate members 10 (plate assemblies 43) mate with adjacent plate assemblies 43 and form common inlet and outlet headers 52 and 54 respectively adaptable to receive and discharge a fluid medium therethrough as previously explained. The serpentine fin elements 46 are positioned such that the second series of fluid flow passageways 50 extend in a direction perpendicular to the central flow region 44 formed between each pair of mated plate members thereby achieving a cross-flow pattern of fluid distribution through the heat exchanger core structure 42.

Figure 4:
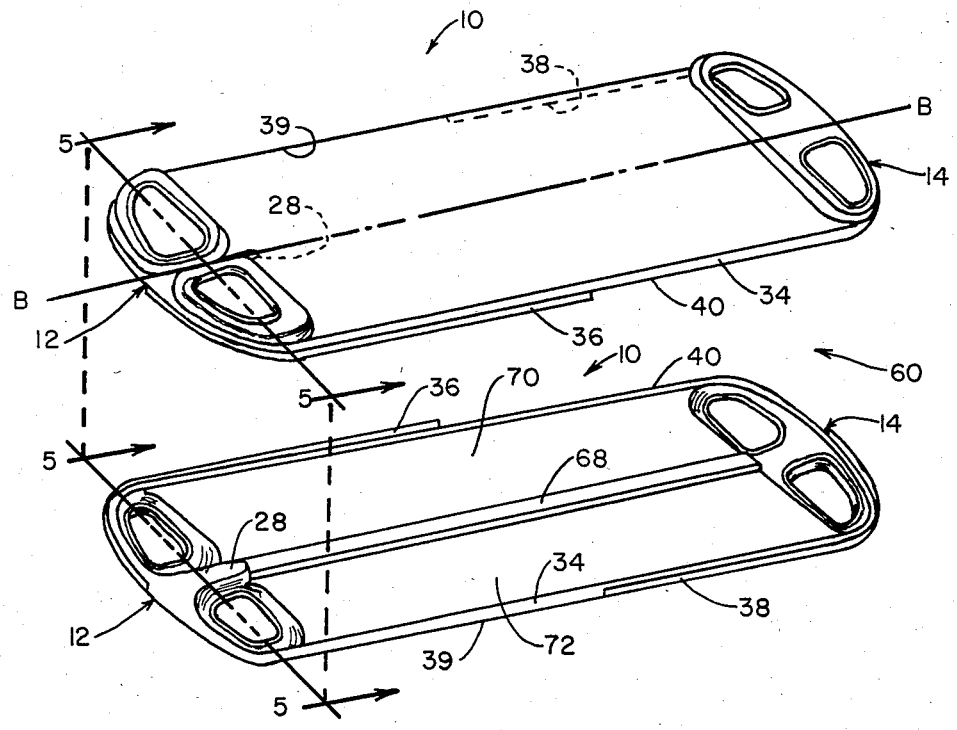
FIG. 4 is an exploded perspective view of a double-pass arrangement of one plate assembly utilizing the plate members of FIG. 1.
Figure 5:
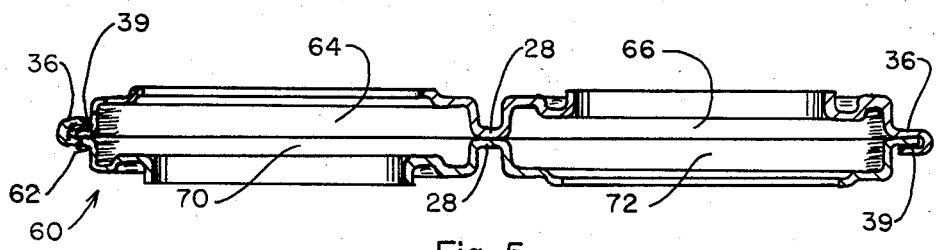
FIG. 5 is a cross-sectional view of the double-pass plate aseembly of FIG. 4 in assembled condition taken through the plane 5—5.

Depending upon how each pair of core plate members 10 forming the plate assemblies 43 are joined together, either a single-pass or a double-pass flow system within each plate assembly may be achieved. For example, when two plate members 10 are assembled in face-to-face relationship with each other by rotating one plate member 180° about its longitudinal axis B—B as shown in FIG. 4, a mated plate assembly 60 (FIG. 5) is formed wherein tne raised partitioning or pass ribs 28 of the respective header portions 12 are positioned and arranged in abutting relationship with each other such that the assembled header portion 62 formed thereby at one end portion thereof is separated into two distinct flow sections 64 and 66 as shown in FIG. 5. FIG. 5 is a cross-sectional view of the plate assembly 60 taken through the plane 5—5 of FIG. 4 showing one method of joining complementary plate members together wherein each of the flange tabs 36 and 38 is folded over or crimped around the respective untabbed portions 39 and 40. This method of mating a pair of complementary plate members provides additional strength and stability to the plate assemblies 43. The flow sections 64 and 66 provide a means for coolant fluid to enter and exit the central flow region formed between the mated plate members 10. By arranging one corrugation of an interposed elongated single strip fin member or partitioning rib 68 in alignment with the abutting pass ribs 28 at one end portion thereof and extending the fin member or partitioning rib 68 the full length of the plate assembly 60 to a position adjacent the header portion 14, each plate assembly 60 so assembled is effectively separated into two coolant passes 70 and 72 (FIG. 4). This means that one fluid medium may enter one opening associated with the separated header portion 62 and flow the full length of the plate assembly 60 along one of the passageways 70 or 72 formed therewithin. Upon reaching the opposite end of the plate assembly 60, the fluid medium will reverse direction within the unseparated header portion located at the opposite end thereof and traverse the full length of the second passageway 70 or 72 formed therewithin so as to exit the other opening of the separated header portion 62. A double-pass cross-flow core assembly is formed by stacking a plurality of the double-pass plate assemblies 60 one upon the other and interposing heat transfer fin elements such as the fin elements 46 between adjacent plate assemblies as previously discussed with respect to the core assembly 42 shown in FIG. 3.

Figure 7:
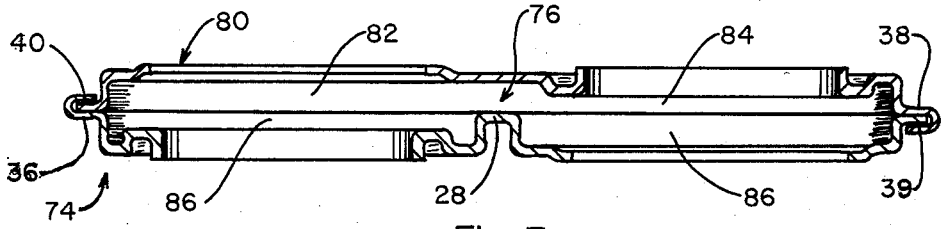
Figure 6:
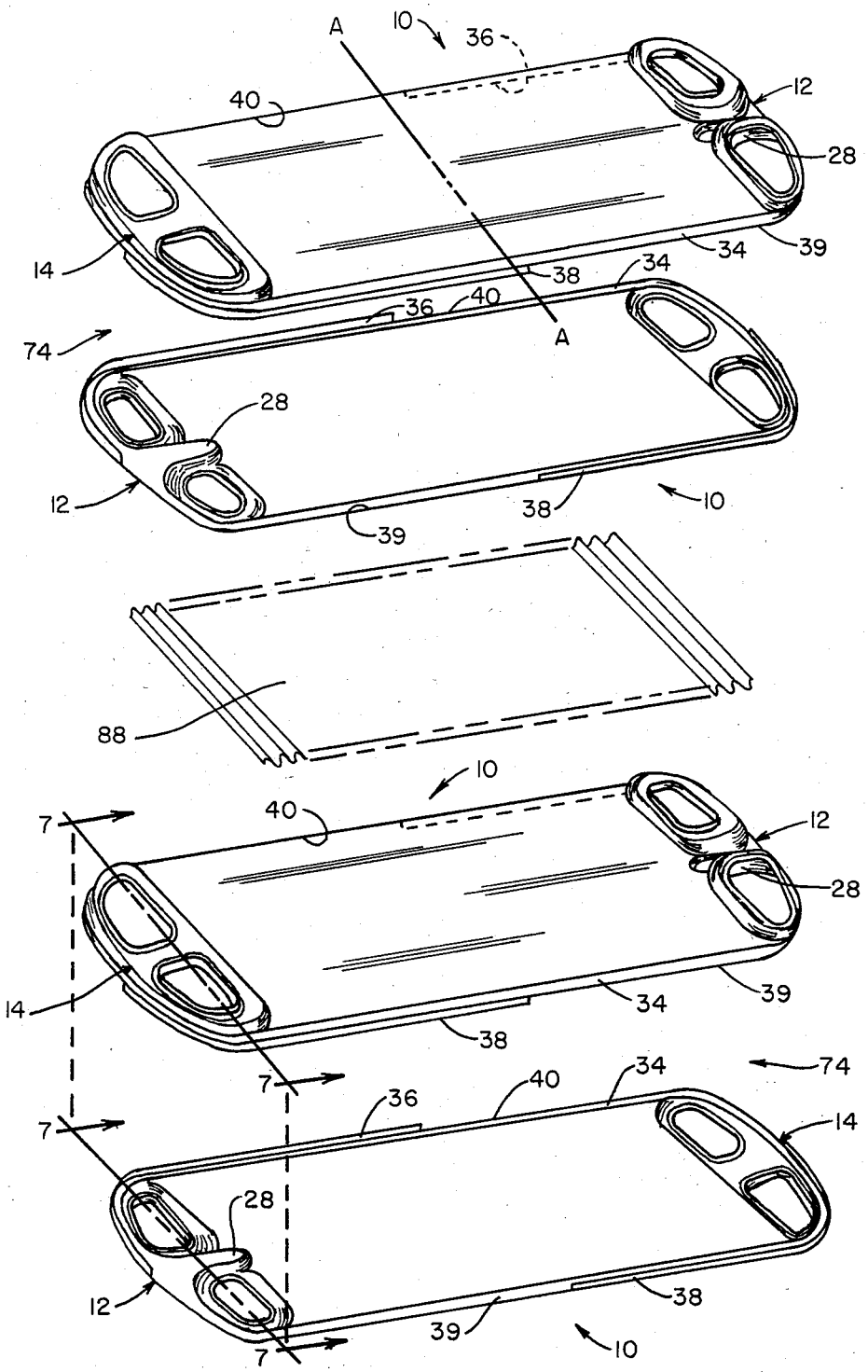
FIG. 6 is an exploded perspective view of a single-pass arrangement of two plate assemblies utilizing the plate members of FIG. 1 with a heat transfer fin element interposed between the adjacent plate assemblies; and, FIG. 7 is a cross-sectional view of one of the single-pass plate assemblies of FIG. 6 in assembled condition taken through the plane 7—7.

An important aspect of the construction of the present plate members 10 is to provide a plate design which can also be utilized in the assembly of a single-pass core unit. As described above, a double-pass plate assembly is achieved by rotating one of the plate members 10 forming each pair of mated plate members 180° about its longitudinal axis as shown in FIGS. 4 and 5. In contrast, a single-pass flow arrangement can be achieved by rotating one of said pair of plate members 10 180° about its transverse axis A—A shown in FIGS. 1 and 6 and thereafter joining said plate members 10 in face-to-face relationship with each other as previously explained to form a mated plate assembly such as the plate assemblies 74 shown in FIGS. 6 and 7. In this situation, since the partitioning ribs 28 of the respective header portions 12 associated with each plate member 10 are located at opposite ends of the plate assemblies 74, a space 76 (FIG. 7) exists within both header portions formed thereby such as the header portion 80 shown in FIG. 7 for allowing a fluid medium to communicate from one side 82 to the other side 84 therewithin and neither header portion is separated as hereinbefore described. FIG. 7 is a cross-sectional view of one of the plate assemblies 74 taken through the plane 7—7 of FIG. 6. This orientation of mated plate members 10 enables a coolant fluid to enter one header portion and flow freely within the single flow region 86 formed therebetween and thereafter exit through the header portion located at the opposite end thereof. Like the double-pass cross-flow core construction, a single pass cross-flow core assembly can be achieved by simply stacking a plurality of single-pass plate assemblies 74 in a manner substantially similar to the forming of the double-pass cross-flow core assembly previously described with respect to FIGS. 4 and 5 and interposing heat transfer fin elements such as tne fin elements 88 (FIG. 6) between the adjacent plate assemblies 74. It is also important to note that when two of the present plate members 10 are joined together in mating relationship as just described to form a single-pass flow arrangement within each plate assembly 74, the flange tabs 36 and 38 of one plate member 10 still register with and engage respective untabbed portions 39 and 40 of the complementary plate member 10. As hereinbefore described, each of the flange tabs 36 and 38 can be folded over or crimped around the respective untabbed portions 39 and 40 to further provide additional strength and stability to the plate assemblies 74. This is best shown in FIG. 7. Therefore, regardless of how one of the present plate members 10 is oriented and mated in face-to-face relationship with its complementary plate member 10, the tabbed and untabbed portions associated respectively therewith will always register with and engage one another to from the continuous sidewall sucn as the sidewall 41 (FIG. 3) between the mated plate members and to effect joinder therebetween. Additionally, regardless of the relative orientation of the mated plate members 10, that is, the forming of a single-pass or a double-pass flow system, the openings in the respective header portions of the plate assemblies formed thereby will always lie in registration with the corresponding openings on an adjacent plate assembly to fluidly interconnect said pair of plate members and any plurality thereof.

It should be noted that all of the structural members comprising the two core embodiments which utilize the present plate members 10 are formed of a suitable heat conducting metal such as aluminum, copper and/or copper clad, or stainless steel, and all such members may be interconnected by any suitable bonding means such as by brazing to form the unitized core structure. In addition, suitable manifolding at one or both ends of the core structure is also provided for directing the two fluid media through their respective flow passageways formed within the core assembly in heat exchange relationship with each other to effect heat transfer therebetween. The provision for providing either a single-pass or a double-pass flow arrangement within a core structure by utilizing the present plate members 10 significantly reduces the tooling requirements for producing a family of heat exchangers as needed for various applications as previously explained. In addition, it is also recognized that the overall size and shape of the individual plate members 10 may be conveniently fashioned into a variety of sizes and configurations, for example, rectangular, square, oval, circular, hexagonal, or other configurations, so as to be compatible with the size and shape of the manifold housing into which it may be mounted or to conform with any other space limitations without impairing the teachings and practice of the present plate construction. Use of the present plate members 10 provides an improved means for providing separation of adjacent flow passageways within the central flow region formed between the respective pairs of mated plate members and although the present plate members are particularly suitable for use in charged air cooler assemblies for turbo-charged engines, they may likewise be effectively utilized in a wide variety of heat exchanger applications.

Thus there has been shown and described novel means for forming a single-pass or a double-pass cross-flow core arrangement by utilizing a universal core plate member which fulfills all of the objects and advantages sought therefor. Many changes, variations, modifications, and other uses and applications of the present plate construction will, however, become apparent to those skilled in the art after considering this specification and the accompanying drawings, and all such changes, variations, modifications, and other uses and applications which do not depart from the spirit and scope of the present invention are deemed to be covered by the invention which is limited only by the claims which follow.

What is claimed is:

1. A plate member adaptable for use in a heat exchanger core assembly including a plurality of similarly constructed plate members mated together in pairs to form a central flow region between said mated plate members, each of said plate members comprising a generally planar member having oppositely facing surfaces associated therewith, said plate member having opposed side edge portions, opposed end portions and a header portion located respectively adjacent each of said opposed end portions, each of said header portions having at least one pair of spaced openings associated therewith, said header openings being positioned and arranged so as to be adaptable to register with corresponding header openings of a similarly constructed plate member when positioned adjacent thereto, a partitioning rib member located in one of the header portions associated with said plate member, said partitioning rib member being positioned extending longitudinally between tne pair of spaced openings associated with said respective header portion, a plurality of spaced flange tab portions extending outwardly away from one of said plate surfaces along the periphery thereof, a plurality of untabbed portions defined by the space between said plurality of flange tab portions along the periphery of said plate member, said tabbed and untabbed portions being positioned and arranged such that the spaced flange tab portions of one of said plate members cooperate with the untabbed portions of a similarly constructed plate member when said plate members are placed in mating face-to-face relationship with each other thereby forming a continuous side wall therearound regardless of which of said header portions are positioned adjacent each other when said pair of similarly constructed plate members are positioned in mating relationship with each other.

2. The plate member defined in claim 1 wherein a continuous raised peripheral edge portion extends around one of the surfaces of said plate member and said plurality of spaced flange tab portions extend outwardly therefrom.

3. The plate member defined in claim 2 wherein said partitioning rib member lies coplanar with said raised peripheral edge portion and extends from said peripheral edge portion to a position between the spaced openings associated with said one header portion.

4. The plate member defined in claim 1 wherein at least one opening associated with each of said header portions includes circumferential flange means, said circumferential flange means being receivable and insertable within corresponding header openings on an adjacent plate member regardless of which of said header portions of said adjacent plate member are positioned in abutting relationship therewith.

5. The plate member defined in claim 1 wherein said header portions are formed integral with said plate member.

6. The plate member defined in claim 1 wherein said continuous raised peripheral edge portion is formed integral with said plate member.

7. The plate member defined in claim 1 wherein said partitioning rib member extends longitudinally from a position between the pair of spaced openings associated with said one header portion to a position adjacent said other header portion.

8. The plate member defined in claim 1 wherein said plurality of spaced flange tab portions includes first and second flange tab portions, said first flange tab portion extending from a position adjacent the partitioning rib member associated with said one header portion to an intermediate position along the periphery of one of the side edge portions of said plate member such that the overall length of said first flange tab portion is equal to approximately one quarter of the distance around the periphery of said plate member, said second flange tab portion extending from a position adjacent the space between said pair of openings associated with said other header portion to an intermediate position along the periphery of the other of said side edge portions such that the overall length of said second flange tab portion is equal to approximately one quarter of the distance around the periphery of said plate member.

9. A heat exchanger construction comprising a plurality of plate assemblies joined together in a stackable arrangement one upon the other, each plate assembly being formed by a pair of similar plate members placed in mating relationship with each other to form a central flow region therebetween, each of said plate members having oppositely facing surfaces, opposed side edge portions and opposed end portions, said plate member also including first and second header portions located respectively adjacent said opposed end portions, each of said first and second header portions having at least one pair of spaced openings associated therewith, means associated with at least one of the openings of said first and second header portions adaptable for registering with corresponding openings on an adjacent plate assembly when said adjacent plate assembly is placed in stackable arrangement therewith, a partitioning rib member positioned extending longitudinally between the pair of spaced openings associated with one of said header portions, a plurality of spaced flange tab portions extending upwardly away from one of said plate surfaces along the periphery thereof, a plurality of untabbed portions defined by the space along the periphery of said plate member between said spaced flange tab portions, said flange tab portions and said untabbed portions being positioned and arranged around the periphery of each of said plate members such that the spaced flange tab portions of one plate member cooperate with the untabbed portions of a mating plate member to form a continuous side wall around said mated plate members and the central flow region formed therebetween, said continuous side wall being formed regardless of which of said first and second header portions associated with each of said pairs of mated plate members are positioned respectively adjacent to each other, means to sealably connect each of said pairs of mated plate members, each of said pairs of mated plate members being adaptable for receiving and carrying a first fluid medium therethrough, and fin means positioned between adjacent plate assemblies, said fin means extending throughout the area formed between said plate assemblies thereby forming a second series of fluid passageways therebetween for transporting a second fluid medium therethrough.

10. The heat exchanger construction defined in claim 9 wherein a continuous raised peripheral edge portion extends around each of said plate members on one of said plate surfaces and said plurality of spaced flange tab portions extend upwardly therefrom.

11. The heat exchanger construction defined in claim 10 wherein said partitioning rib member lies coplanar with said peripheral edge portion and extends from said peripheral edge portion to a position between the spaced openings associated with said one header portion.

12. The heat exchanger construction defined in claim 10 wherein said continuous raised peripheral edge portion is formed integral with each of said plate members.

13. The heat exchanger construction defined in claim 9 wherein said registration means associated with at least one of the openings of said first and second header portions includes circumferential flange means, said circumferential flange means being receivable and insertable within corresponding header openings on an adjacent plate assembly to maintain said header openings in registration with each other when said adjacent plate assemblies are placed in stackable arrangement one upon the other.

14. The heat exchanger construction defined in claim 13 wherein said circumferential flange means are positioned around certain ones of the openings associated with said first and second header portions such that said circumferential flange means are receivable and insertable within corresponding header openings associated with an adjacent plate assembly regardless of which of said first and second header portions of said adjacent plate assemblies are positioned in abutting relationship with each other.

15. The heat exchanger construction defined in claim 9 wherein said pair of similar plate members forming each of said plate assemblies are mated in face-to-face relationship with each other such that the partitioning rib member associated with one of said header portions of one plate member is placed in abutting relationship with the partitioning rib member associated with the other of said similar plate member, and wherein an elongated partitioning member is placed in mating alignment with said abutting rib members at one end portion thereof, said elongated partitioning member extending to a position adjacent the other header portions at the opposite end of said mated plate members thereby effectively separating the central flow region formed therebetween into two separate flow paths.

16. The heat exchanger construction defined in claim 9 wherein said pair of similar plate members forming each of said plate assemblies are mated in face-to-face relationship with each other such that the partitioning rib member associated with one of the header portions of said respective plate members are placed in non-abutting relationship to each other at opposite ends of said mated plate members.

17. The heat exchanger construction defined in claim 9 wherein said first and second header portions are formed integral with each of said plate members.

18. The heat exchanger construction defined in claim 9 wherein said spaced flange tab portions are positioned and arranged along the periphery of each of said plate members such that each flange tab portion has a corresponding untabbed portion opposed thereof.

19. The heat exchanger construction defined in claim 9 wherein said plurality of spaced flange tab portions includes a pair of said tab portions, one of said flange tab portions extending from a position adjacent the partitioning rib member associated with one of said header portions to an intermediate position along the periphery of one of the side edge portions of said plate member such that the overall length of said flange tab portion is equal to approximately one quarter of the distance around the periphery of said plate member, said other flange tab portion extending from a position adjacent the space between said pair of openings associated with the other of said header portions to an intermediate position along the periphery of the other of said side edge portions such that the overall length of said other flange tab portion is equal to approximately one quarter of the distance around the periphery of said plate member.

20. The heat exchanger construction defined in claim 9 wherein each of said plate members is generally rectangular in shape and is formed of a suitable heat conducting material.

21. The heat exchanger construction defined in claim 9 wherein said second series of fluid passageways formed between adjacent plate assemblies extend in a direction perpendicular to the central flow region formed between each pair of mated plate members thereby achieving a cross-flow pattern of fluid distribution through said heat exchanger construction.

* * * * *